US006729321B2

(12) United States Patent
Ho

(10) Patent No.: US 6,729,321 B2
(45) Date of Patent: May 4, 2004

(54) PAINT BALL GUN HAVING A COMBINED HOPPER/FEEDER

(75) Inventor: Stephen Ho, Sugarland, TX (US)

(73) Assignee: Avalon Manufacturing Company, Houston, TX (US)

( * ) Notice: Subject to any disclaimer, the term of this patent is extended or adjusted under 35 U.S.C. 154(b) by 0 days.

(21) Appl. No.: 10/187,386

(22) Filed: Jul. 1, 2002

(65) Prior Publication Data

US 2004/0000300 A1 Jan. 1, 2004

(51) Int. Cl.[7] ..... F41B 11/02
(52) U.S. Cl. ..... 124/49; 124/50; 124/73
(58) Field of Search ..... 124/49, 50, 73, 124/74

(56) References Cited

U.S. PATENT DOCUMENTS

| | | | | | |
|---|---|---|---|---|---|
| 5,282,454 | A | * | 2/1994 | Bell et al. | 124/49 |
| 5,494,024 | A | | 2/1996 | Scott | 124/73 |
| 5,505,188 | A | | 4/1996 | Williams | 124/74 |
| 5,515,838 | A | | 5/1996 | Anderson | 124/76 |
| 5,572,982 | A | | 11/1996 | Williams | 124/74 |
| 5,630,406 | A | | 5/1997 | Dumont | 124/56 |
| 5,669,369 | A | | 9/1997 | Scott | 124/73 |
| 5,673,679 | A | | 10/1997 | Walters | 124/53.5 |
| 5,778,868 | A | | 7/1998 | Shepherd | 124/76 |
| 5,791,325 | A | | 8/1998 | Anderson | 124/56 |
| 5,809,983 | A | * | 9/1998 | Stoneking | 124/50 |
| 5,850,826 | A | | 12/1998 | Guthrie | 124/62 |
| 5,896,850 | A | | 4/1999 | Sullivan, Jr. | 124/74 |
| 5,947,100 | A | | 9/1999 | Anderson | 124/45 |
| 5,988,153 | A | | 11/1999 | Yoshimura | 124/81 |
| 5,993,215 | A | | 11/1999 | Kotsiopoulos et al. | 434/21 |
| 6,003,504 | A | | 12/1999 | Rice et al. | 124/73 |
| 6,055,975 | A | * | 5/2000 | Gallagher et al. | 124/50 |
| 6,062,208 | A | | 5/2000 | Seefeldt et al. | 124/71 |
| 6,109,252 | A | | 8/2000 | Stevens | 124/51.1 |
| 6,138,656 | A | | 10/2000 | Rice et al. | 124/73 |
| 6,142,136 | A | | 11/2000 | Velasco | 124/71 |
| 6,142,137 | A | | 11/2000 | Maclaughlin | 124/72 |
| 6,223,658 | B1 | | 5/2001 | Rosa et al. | 102/501 |
| 6,226,915 | B1 | | 5/2001 | Kotsiopoulos | 42/71.02 |
| 6,233,928 | B1 | | 5/2001 | Scott | 60/407 |
| 6,273,080 | B1 | | 8/2001 | Sullivan, Jr. | 124/84 |
| 6,276,354 | B1 | | 8/2001 | Dillon | 124/74 |
| 6,305,367 | B1 | * | 10/2001 | Kotsiopoulos et al. | 124/49 |
| 6,305,941 | B1 | | 10/2001 | Kotsiopoulos et al. | 434/11 |
| 6,371,099 | B1 | | 4/2002 | Lee | 124/66 |

* cited by examiner

*Primary Examiner*—John A. Ricci
(74) *Attorney, Agent, or Firm*—Robert W. Strozier

(57) ABSTRACT

A paint ball gun magazine or a combined hopper/feeder apparatus is disclosed, where the magazine includes a closing assembly designed to allow the magazine to transition between a closed state and an open state, and to a paint ball gun including a closable magazine or hopper/feeder apparatus.

22 Claims, 13 Drawing Sheets

100

200

800
820
814
826
812
828
830
818
804
822
802
824

830
804
802
818
812
824

832
802
822
830
822
804
812
824
832
834

PAINT BALL GUN HAVING A COMBINED HOPPER/FEEDER

BACKGROUND OF THE INVENTION

1. Field of the Invention

The present invention relates to a combined hopper/feeder apparatus for paint ball guns and paint ball guns having a combined hopper/feeder apparatus and to method for using same.

More particularly, the present invention relates to a combined hopper/feeder apparatus for paint ball guns and an improved paint ball gun including a combined hopper/feeder apparatus, where the hopper/feeder apparatus includes an outer shell, an interior designed to hold paint balls, a first aperture having a lip for filling the hopper/feeder apparatus with paint balls, a second aperture having a paint ball dispensing tube depending from a center portion of the apparatus and a retractable closing assembly located at an upper portion of the dispensing tube for preventing paint balls from entering the depending tube until the closing assembly is retracted. The gun can also include a lid designed to engage the lip of the first aperture in a detachable manner and optionally a connecting member; preferably, the lid is pivotally mounted on, a top of the hopper/feeder apparatus so that the lid can be opened and closed. The present invention also relates to methods for making and using same.

2. Description of the Related Art

Numerous types of paint ball guns have been developed and used in a variety of manners, such as in simulated war games. These paint ball guns are generally powered by $CO_2$ cartridges or cylinders which, generally, propel the paint balls at a specified velocity, such as three hundred (300) feet per second out of the gun barrel. In general, the prior art paint ball guns include a typical firearm type mechanism including a bolt, spring and cocking handle.

These prior art paint ball guns generally include a paint ball holder/hopper/feeder apparatus, typically called a hopper that is secured to the gun by a connector where the connector has a first end that attaches to a feed tube of the gun and a second end that attaches to the hopper. Regardless of the method for connecting, e.g., friction, threaded connections or the like, the guns includes a hopper and a feeder. The hopper generally includes a detachable lid, which is detached and paint balls are loaded into the hopper from a feeder. After the paint balls are added to the hopper, the lid is reattached and the feeder is either dropped on placed in a bag or back pack. Although the system is workable, considerable time can be lost in reloading—transferred paint balls from the feeder to the hopper. Moreover, the transfer is wrought with difficulties and generally always results in spilled paint balls.

Thus, there is a need in the art for an improved paint ball gun including a combined hopper/feeder apparatus, where no paint ball transfer is required.

SUMMARY OF THE INVENTION

The present invention provides a combined paint ball hopper/feeder apparatus having a retractable closing assembly, where the feeder/hopper apparatus is designed to hold a plurality of paint balls and the closing assembly is designed to retain the paint balls in the apparatus until the assembly is retracted by a user. The major benefit of the apparatus is the elimination of the feeder tubes used to fill prior art hoppers and the need to transfer paint balls to the hopper during a game.

The present invention also provides a paint ball gun apparatus including: a gun assembly having a handle, a barrel, a gas inlet, and a paint ball feed tube; and a feeder/hopper or magazine having an outer shell, an interior designed to hold paint balls, preferably a smooth interior, a first aperture having a lip for receiving paint balls, a second aperture having a paint ball dispensing tube depending from a center portion of the magazine, preferably a lowermost portion, and a retractable closing assembly at an upper portion of dispensing tube, where: the magazine dispensing tube is designed to engage the gun feed tube to form a conduit for supplying paint balls to the gun barrel; the gas inlet is designed to be connected to a source of propellant gas for propelling paint balls out of the barrel; the first aperture of the magazine is designed to receive paint balls; and the closing assembly is designed to hold the paint balls inside the interior of the magazine until the closing assembly is retracted by a user, permitting the paint balls to travel into the conduit and into the barrel for shooting out of the barrel. The magazine preferably also includes a lid designed to engage the lip of the first aperture in a detachable manner, preferably, the lid is pivotally mounted on a top of the apparatus so that the lid can be opened and shut.

The present invention also provides a method for supplying paint balls to a paint ball gun including the steps of: loading paint balls into a magazine of this invention with the retractable closing assembly unretracted; connecting a depending tube of the magazine to the feed tube of a paint ball gun to form a conduit from the magazine to the barrel; and retracting the closing assembly to connect the magazine interior to the conduit so that paint balls can enter the barrel via the conduit.

The present invention also provides a method for shooting paint balls from a paint ball gun including the steps of: loading paint balls into a magazine of this invention with the retractable closing assembly unretracted; connecting a depending tube of the magazine to the feed tube of a paint ball gun to form a conduit from the magazine to the barrel; retracting the closing assembly to connect the magazine interior to the conduit so that paint balls can enter the barrel via the conduit; and firing a paint ball at a target. The method can also include the step of aiming the gun prior to firing.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1B:
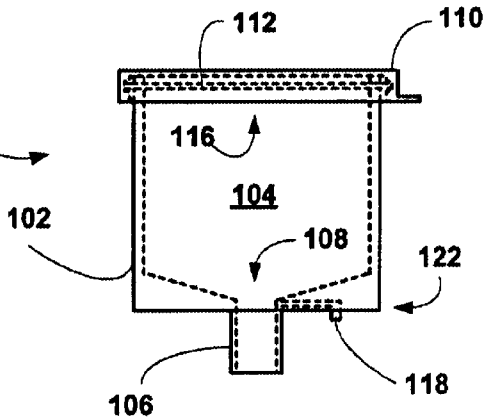
FIGS. 1A–B depicts a preferred embodiment of a hopper/feeder or magazine apparatus of this invention in an open and closed state, respectively.

The inventor has found that a paint ball gun can be constructed with a combined hopper/feeder or assembly or apparatus sometimes referred to herein as a magazine. The combined hopper/feeder apparatus or magazine includes a retractable closing assembly designed to block a depending tube depending from a bottom portion of the magazine and hold a quantity of paint balls in the hopper/feeder apparatus or magazine until a user retracts the closing mechanism so that the paint balls can exit the magazine through the dispensing tube. The magazines are designed to detachably engage a feed tube of the gun so that when the closing assembly is retracted, the paint balls can drop from the magazine through the dispensing tube and into the feed tube of the gun for firing. The gun and magazine can also be equipped with detachable locking connectors so that the magazine can be detachably locked to the gun, where one connector is associated with a distal end of the depending tube of the magazine and the second connector is associated with the feed tube of the gun. The locking connectors are designed to reduce detachment of the magazine from the gun during use. The gun assembly can also include a connecting member interposed between the hopper/feeder apparatus and the gun. Preferably, the connecting member includes a detachable locking connectors at its proximal and distal end for interlocking the connecting member between the depending tube of the magazine and the feed tube of the paint ball gun.

The present invention broadly relates to a combined hopper/feeder apparatus or magazine including an outer shell, an interior designed to hold paint balls, preferably smooth, a first aperture for receiving paint balls, a second aperture having a paint ball dispensing tube depending from a bottom portion thereof for dispensing paint balls and a closing system associated with an upper portion of dispensing tube for blocking the depending tube. The magazine also preferably includes a lid designed to close the first aperture, which is preferably pivotally mounted on a top portion of the magazine. The first aperture also preferably includes a lip or other member designed to engage the lid and hold the lid in place until opened by a user.

The present invention also broadly relates to a paint ball gun including a hopper/feeder apparatus of this invention. The guns can include a locking connector on the hopper/feeder apparatus and on a locking connector on the feed tube of the gun, where the two connectors are designed to engage each other in a detachably locking manner. The gun also includes a connecting member having a second locking connector, where the two locking end are designed to lockingly secure the hopper/feeder apparatus to the connecting member with sufficient locking force to decrease or eliminate the hopper/feeder apparatus falling off of the gun during training exercises or games.

The present invention also broadly relates to a method for supplying paint balls to a paint ball gun including the steps of: loading paint balls into a magazine of this invention with the retractable closing assembly unretracted; connecting a depending tube of the magazine to the feed tube of a paint ball gun to form a conduit from the magazine to the barrel; and retracting the closing assembly to connect the magazine interior to the conduit so that paint balls can enter the barrel via the conduit.

The present invention also broadly relates to a method for shooting paint balls from a paint ball gun including the steps of: loading paint balls into a magazine of this invention with the retractable closing assembly unretracted; connecting a depending tube of the magazine to the feed tube of a paint ball gun to form a conduit from the magazine to the barrel; retracting the closing assembly to connect the magazine interior to the conduit so that paint balls can enter the barrel via the conduit; and firing a paint ball at a target. The method can also include the step of aiming the gun prior to firing.

The hopper/feeder apparatus can be constructed in any suitable geometry, provided that the paint balls can reliably flow from the hopper/feeder apparatus through a delivery conduit to the barrel of the paint ball gun for ultimate firing from the gun. Preferred geometric shapes include, without limitation, banana-shapes, spherical shapes, hemispherical shapes, quadrilateral shapes such as square or rectangular shapes, triangular shapes, or any other shape that provides a paint ball reservoir and a conduit for paint balls to drop from the reservoir to the gun barrel one at a time. The hopper/ feeder apparatus or magazine can be of a unitary construction or can be constructed of multiple parts that are fastened together by fasteners or snap together as is well known in the art.

Suitable materials out of which the hopper/feeder apparatus can be constructed include, without limitations, metals, plastics, composites, ceramics, or the like, or mixtures or combinations thereof. Preferably, the hopper/feeder apparatus is constructed out of plastics or composites or mixtures or combinations thereof. Suitable metals include, without limitation, aluminum and its alloys such as aluminum-magnesium alloys or the like, titanium, steel or other iron alloys, copper and its alloys such as bronze, brass or the like, or any other metal or its alloys and mixture or combinations thereof. Suitable plastics include, without limitation, polyolefins such as polyethylene, polypropylene, polybutylene, polyhexylene, polystyrene, polyalphamethylstyrene, or the like or copolymers thereof, acrylics, urethanes, polyesters, thermoplastics, thermal setting resins, thermoplastic elastomers, liquid crystal polymers, polyalkyleneoxides, or any other structural plastic suitable for making a durable paint ball hopper/feeder apparatus. Suitable composites includes, without limitation, polymer matrices selected from the plastics listed above reinforced by a fiber such as carbon fibers, polyamides such as Kevlar, boron-nitride fibers, glass fibers, or the like or mixture or combination thereof.

Suitable material out of which the hopper/feeder apparatus covers can be made include, without limitation, elastomers such as natural or synthetic rubbers or the like, urethanes rubbers, silicon rubbers or any other resilient and shock absorbing materials or mixtures or combinations thereof.

Suitable locking connections include, without limitations, threaded connections comprising a male threaded connector and a female threaded connector, clip rings, cotter pins, snap fittings including a lip and an groove, quick disconnects such as used in water holes, or any other locking connection assembly or combinations thereof. The locking connections can also be rubber inserts position in the connectors in such as way as to engage the other connector to increase the frictional interlocking of the smooth surface of the connectors.

Combined Hopper/Feeder Apparatus—Closable Magazines

Figure 1A:
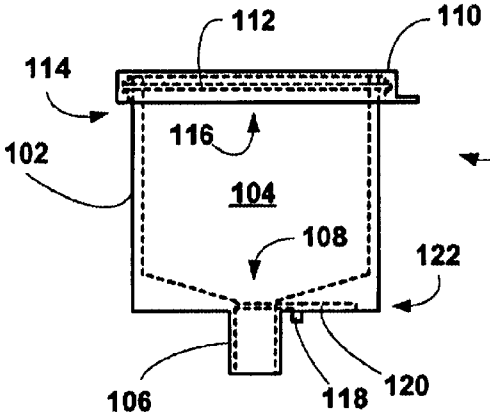

Referring now to FIGS. 1A&B, a preferred embodiment of a combined hopper/feeder apparatus or magazine of this invention, generally 100, is shown to include an open ended, substantially rectangular-shaped outer shell 102, an interior 104 adapted to hold a plurality of paint balls (not shown), a dispensing tube 106 depending from a center region 108 of the magazine 100, a lid 110 designed to detachable engage a lip 112 associated with a top portion 114 of the open end 116 of the magazine 100 and a slidable closing member 118. The closing member 118 slides in a slot 120 in a bottom portion 122 of the outer shell 102. The closing member 118 is designed to prevent paint balls from entering the tube 106 from the interior 104 when in a closed state as shown in FIG. 1A, and to allow paint balls to enter the tube 106 from the interior 104 when in an opened state as shown in FIG. 1B. Thus, when the magazine is first attached to a paint ball gun, the member is in its closed state and the interior is filled with paint balls. Once the magazine is properly attached to the gun and the game is afoot, a user simply slides the member from its closed state to its opened state and starts firing at targets.

Figure 2B:
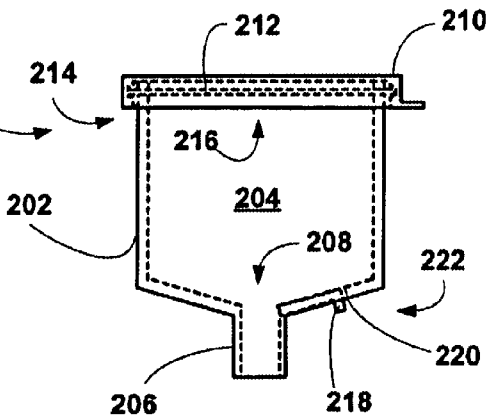
FIGS. 2A–B depicts another preferred embodiment of a hopper/feeder or magazine apparatus of this invention in an open and closed state, respectively.
Figure 2A:
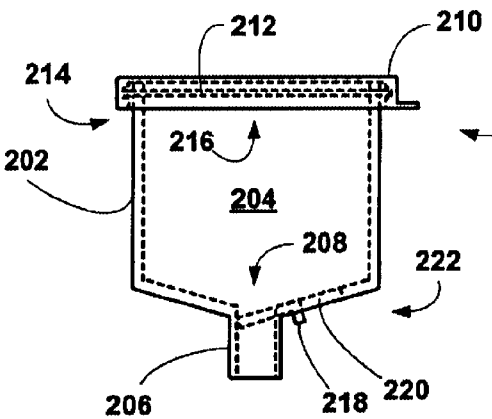

Referring now to FIGS. 2A&B, a preferred embodiment of a combined hopper/feeder apparatus or magazine of this invention, generally 200, is shown to include an open ended, substantially funnel-shaped outer shell 202, an interior 204 adapted to hold a plurality of paint balls (not shown), a dispensing tube or neck 206 depending from a center region 208 of the magazine 200, a lid 210 designed to detachable engage a lip 212 associated with a top portion 214 of the open end 216 of the magazine 200 and a slidable closing member 218. The closing member 218 slides in a slot 220 in a bottom portion 222 of the outer shell 202. The closing member 218 is designed to prevent paint balls from entering the tube 206 from the interior 204 when in a closed state as shown in FIG. 2A, and to allow paint balls to enter the tube 206 from the interior 204 when in an opened state as shown in FIG. 2B. Thus, when the magazine is first attached to a paint ball gun, the member is in its closed state and the interior is filled with paint balls. Once the magazine is properly attached to the gun and the game is afoot, a user simply slides the member from its closed state to its opened state and starts firing at targets.

Figures 3A, 3B:
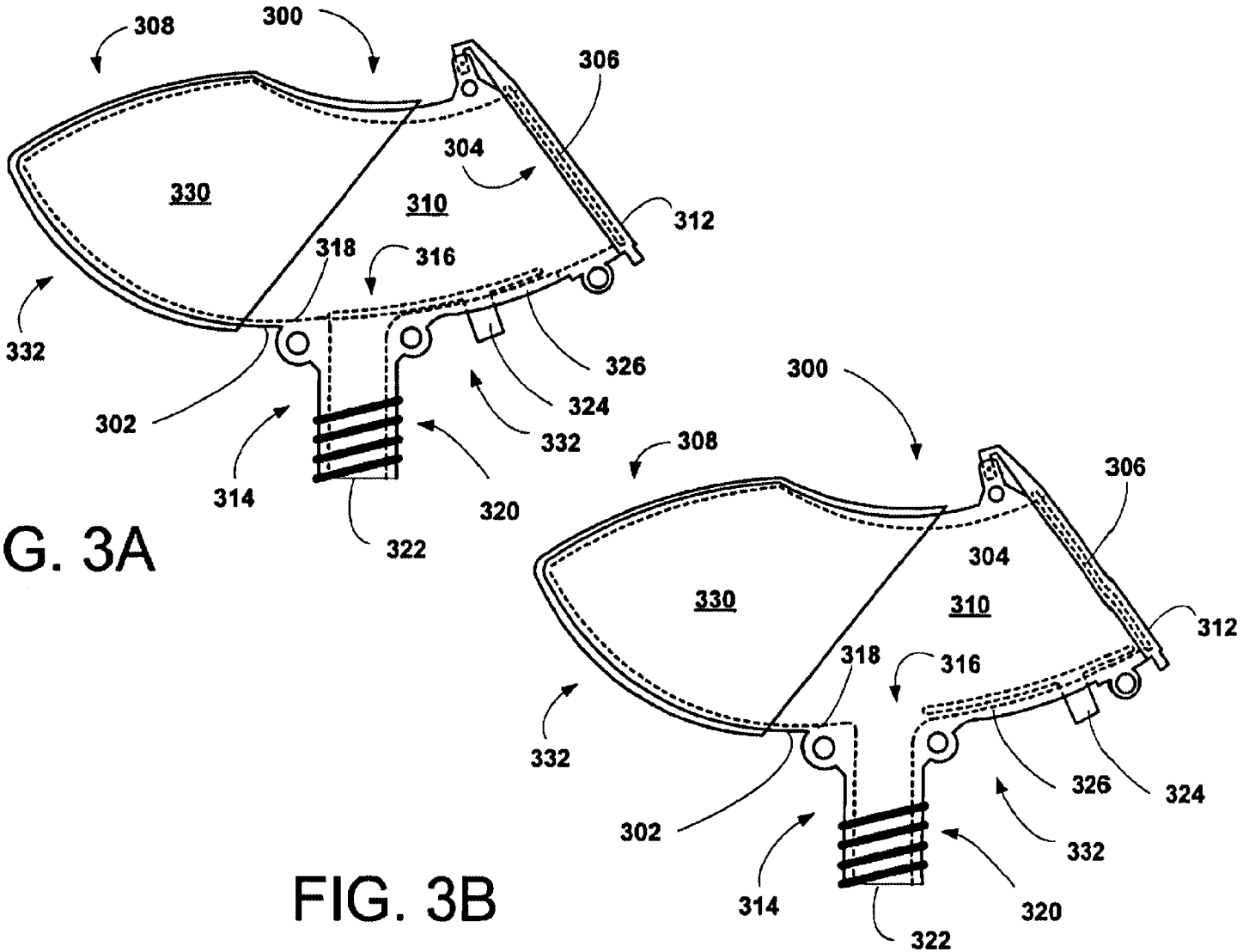
FIGS. 3A–B depicts another preferred embodiment of a hopper/feeder or magazine apparatus of this invention in an open and closed state, respectively.

Referring now to FIGS. 3A&B, a preferred embodiment of a combined hopper/feeder apparatus or magazine of this invention, generally 300, is shown to include a banana-shaped outer shell 302, an opened end 304 having a lip 306, a closed end 308, a paint ball reservoir 310, and a pivotally hinged cover 312. The cover 312 is designed to engage the lip 306 of the opened end 304 so that the opened end 304 can be closed after the hopper/feeder apparatus 300 is filled with paint balls (not shown). The hopper/feeder apparatus 300 further includes a paint ball dispensing neck 314 depending from a lower central region 316 of an arcuate bottom contour 318 of the hopper/feeder apparatus 300. The neck 314 includes a male, threaded connector 320 at its distal end 322, where the connectors 322 is designed to lockingly secure the paint hopper/feeder apparatus 300 to the either a connecting member or directly to the feed tube of a paint ball gun, which of course, would have a female threaded connector. The magazine 300 also includes a slidable closing member 324. The closing member 324 slide in a slot 326 in a bottom portion 328 of the outer shell 302. The closing member 324 is designed to prevent paint balls from entering the neck 314 from the reservoir 310 when in a closed state as shown in FIG. 3A, and to allow paint balls to enter the neck 314 from the reservoir 310 when in an opened state as shown in FIG. 3B. Thus, when the magazine is first attached to a paint ball gun, the member is in its closed state and the interior is filled with paint balls. Once the magazine is properly attached to the gun and the game is afoot, a user simply slides the member from its closed state to its opened state and starts firing at targets. The magazine 300 can also include a protective covering 330 to absorb impacts to a from portion 332 of the outer shell 302.

Figures 4A, 4B:
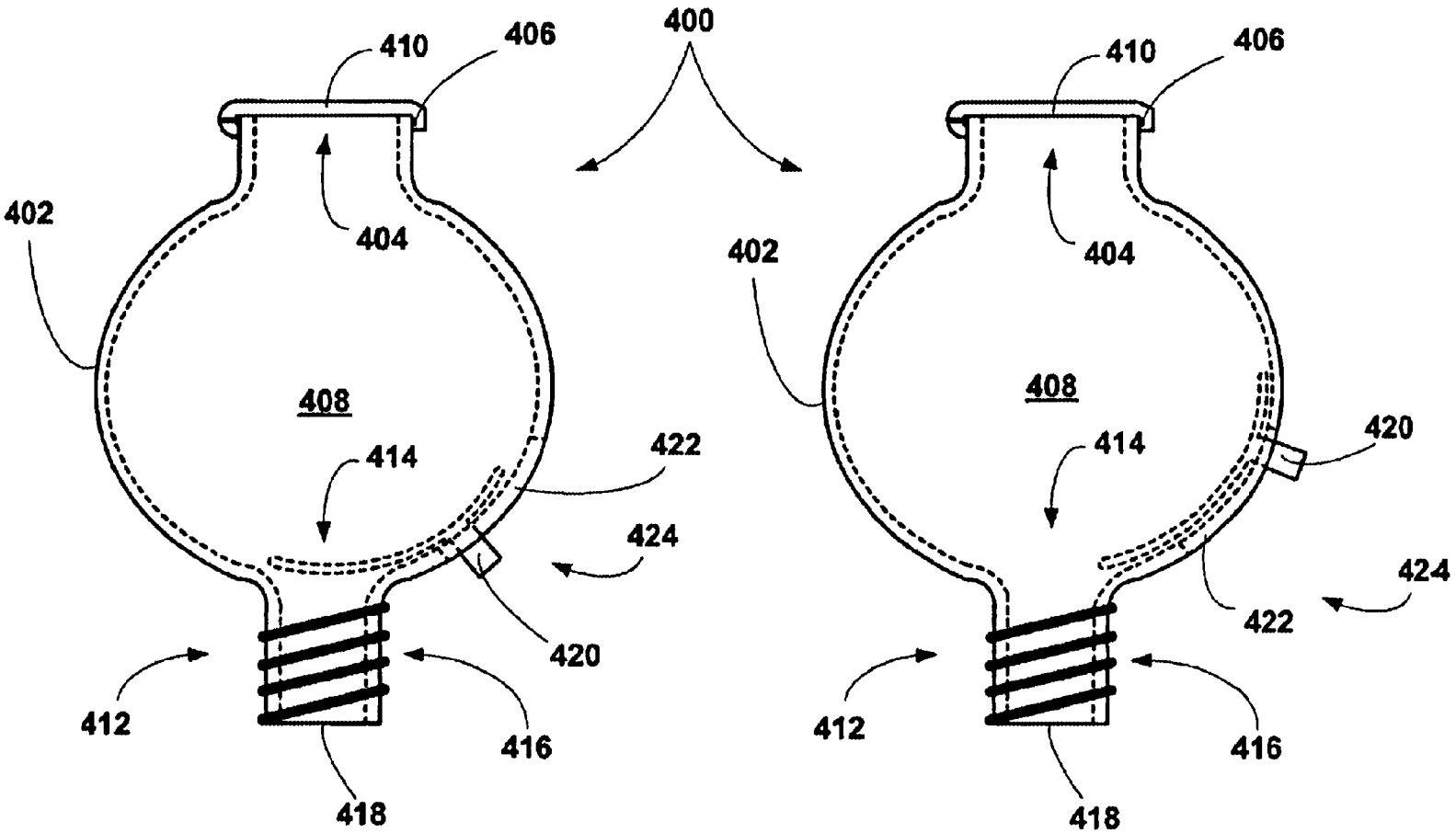
FIGS. 4A–B depicts another preferred embodiment of a hopper/feeder or magazine apparatus of this invention in an open and closed state, respectively.

Referring now to FIGS. 4A&B, a preferred embodiment of a combined hopper/feeder apparatus or magazine of this invention, generally 400, is shown to include a spherically-shaped outer shell 402, an opened end 404 having a lip 406, a paint ball reservoir 408, and a pivotally hinged cover 410. The cover 410 is designed to engage the lip 406 of the opened end 404 so that the opened end 404 can be closed after the hopper/feeder apparatus 400 is filled with paint balls (not shown). The hopper/feeder apparatus 400 further includes a paint ball dispensing neck 412 depending from a lower central region 414 of the magazine 400. The neck 412 includes a male, threaded connector 416 at its distal end 418, where the connectors 422 is designed to lockingly secure the paint hopper/feeder apparatus 400 to the either a connecting member or directly to the feed tube of a paint ball gun, which of course, would have a female threaded connector. The magazine 400 also includes a slidable closing member 420.

The closing member 420 slide in a slot 422 in a bottom portion 424 of the outer shell 402. The closing member 424 is designed to prevent paint balls from entering the neck 414 from the reservoir 410 when in a closed state as shown in FIG. 4A, and to allow paint balls to enter the neck 414 from the reservoir 410 when in an opened state as shown in FIG. 4B. Thus, when the magazine is first attached to a paint ball gun, the member is in its closed state and the interior is filled with paint balls. Once the magazine is properly attached to the gun and the game is afoot, a user simply slides the member from its closed state to its opened state and starts firing at targets.

Paint Ball Guns with Closable Magazines

Figure 5A:
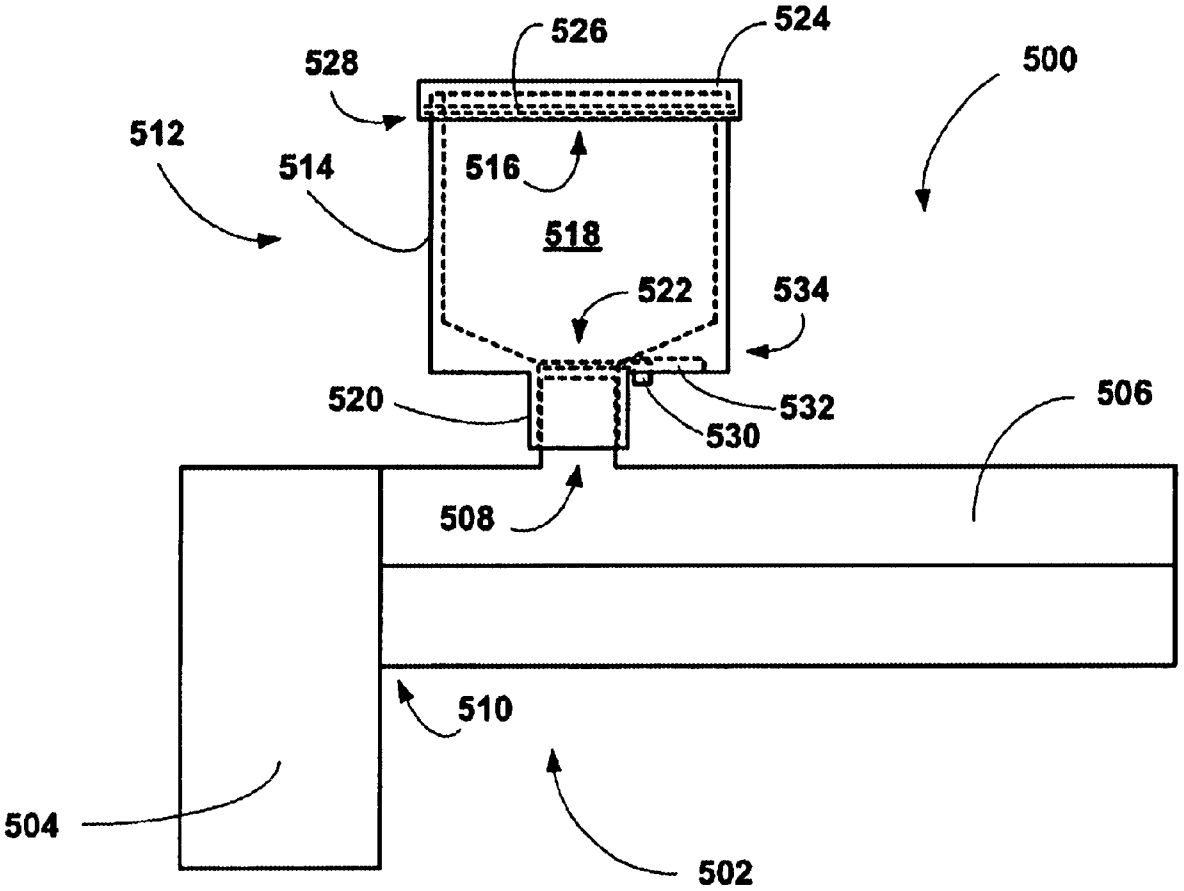
FIG. 5A depicts a preferred embodiment of a paint ball gun having a hopper/feeder apparatus of this invention attached to a gun barrel feed tube via a threaded connection.
Figures 5B, 5C, 5D, 5E:
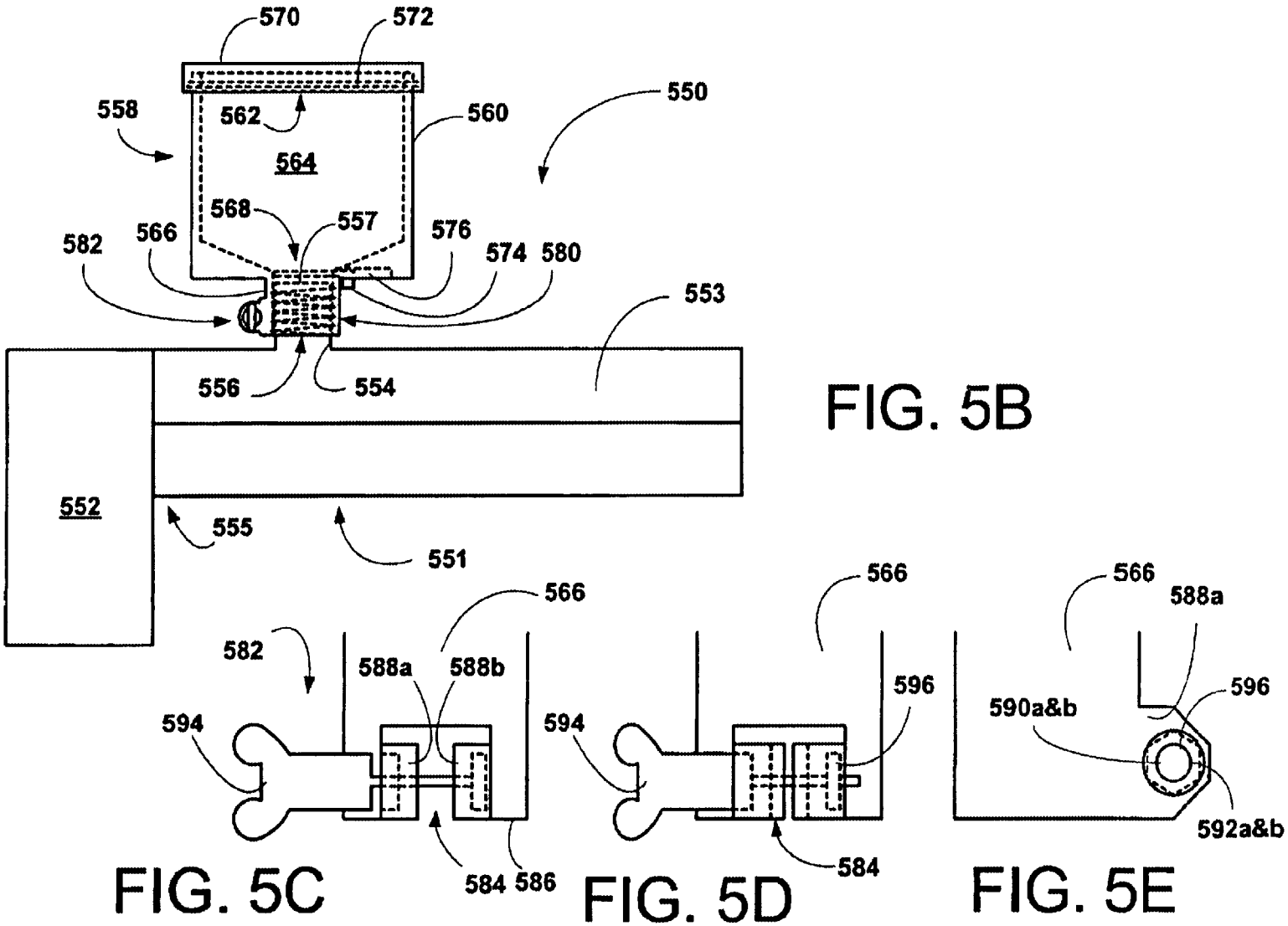
FIG. 5B depicts another preferred embodiment of a paint ball gun having a hopper/feeder apparatus of this invention attached to a gun barrel feed tube via a threaded connection and a tightening member.
FIGS. 5C–E depict two front views and one side view of a preferred embodiment of a tightener for use with the paint ball gun of this invention, where the two front views depict the tightener in an untightened state and a tightened state, respectively.

Referring now to FIG. 5A, a preferred embodiment of a paint ball gun of this invention, generally 500, is shown to include a gun body 502 having a handle 504, a barrel 506 and a hollow, paint ball feed tube 508 extending upward from the barrel 504 near its handle end 510 of the barrel 506. The gun 500 also includes a paint ball hopper/feeder apparatus 512. The hopper/feeder apparatus or magazine 512 includes a substantially rectangular shaped outer shell 514, an open top end 516, an interior 518 adapted to hold a plurality of paint balls (not shown), a dispensing tube 520 depending from a bottom center region 522 of the magazine 512, a lid 524 designed to detachable engage a lip 526 associated with a top portion 528 of the open end 516 of the magazine 512 and a slidable closing member 530. The closing member 530 slides in a slot 532 in a bottom portion 534 of the outer shell 514. The closing member 530 is designed to prevent paint balls from entering the dispensing tube 520 from the interior 518 when in a closed state as shown in FIG. 5A, and to allow paint balls to enter the dispensing tube 520 from the interior 518 when in an opened state as shown in FIG. 5B. Thus, when the magazine is first attached to a paint ball gun, the member is in its closed state and the interior is filled with paint balls. Once the magazine is properly attached to the gun and the game is afoot, a user simply slides the member from its closed state to its opened state and starts firing at targets.

Referring now to FIG. 5B, another preferred embodiment of a paint ball gun of this invention, generally 550, is shown to include a gun body 551 having a handle 552, a barrel 553 and a hollow, paint ball feed tube 554 extending upward from the barrel 553 near its handle end 555. The feed tube 554 includes a male, threaded connector 556 at its distal end 557. The gun 550 also includes a paint ball hopper/feeder apparatus 558.

The hopper/feeder apparatus or magazine 558 includes a substantially rectangular-shaped outer shell 560, an open top end 562, an interior 564 adapted to hold a plurality of paint balls (not shown), a dispensing tube or neck 566 depending from a bottom center region 568 of the magazine 558, a lid 570 designed to detachable engage a lip 572 associated the open end 562 of the magazine 558 and a slidable closing member 574.

The closing member 574 slides in a slot 576 in a bottom portion 578 of the outer shell 560. The neck 566 includes a female, threaded connector 580 and a security tightener 582, where the connectors 556 and 580 are designed to lockingly secure the paint hopper/feeder apparatus 558 to the gun feed tube 554 and the tightener 582 is designed to increase the locking force on the threaded connection between the connectors 556 and 580.

Referring now the FIGS. 5C–E, the tightener 582 includes a T-shaded slot 584 extending upward from a distal end 586 of the tube or neck 566 and two tightening blocks 588*a*&*b* protruding from the distal end 586. The block 588*a* includes an aperture 590*a* and an indentation 592*a* for receiving a wing nut 594. The block 588*b* includes an aperture 592*b* and an indentation 594*b* holding a locking nut 596, where the aperture 590*b* and the nut 596 are adapted to receive and to engage the wing nut 594, respectively. The tightener 582 operates by inserting the wing nut 594 into and through the aperture 590*a* in the block 588*a* and into the aperture 590*b* in the block 588*b* until the wing nut 594 engages the nut 596. Once the wing nut 594 has engaged the locking nut 596, turning the wing nut 594 will cause the blocks 588*a*&*b* to be pulled together as shown in FIG. 5D until the desired tightening force is achieved on the threaded connection between the connectors 556 and 580.

Of course, it should be easily recognized by an ordinary artisan that the feed tube can include a female connector and the hopper/feeder apparatus can include a male connector. It should also be recognized, that by reversing the feed tube connector to a female connector, any tightener would have to be associated with the feed tube.

Figure 6A:
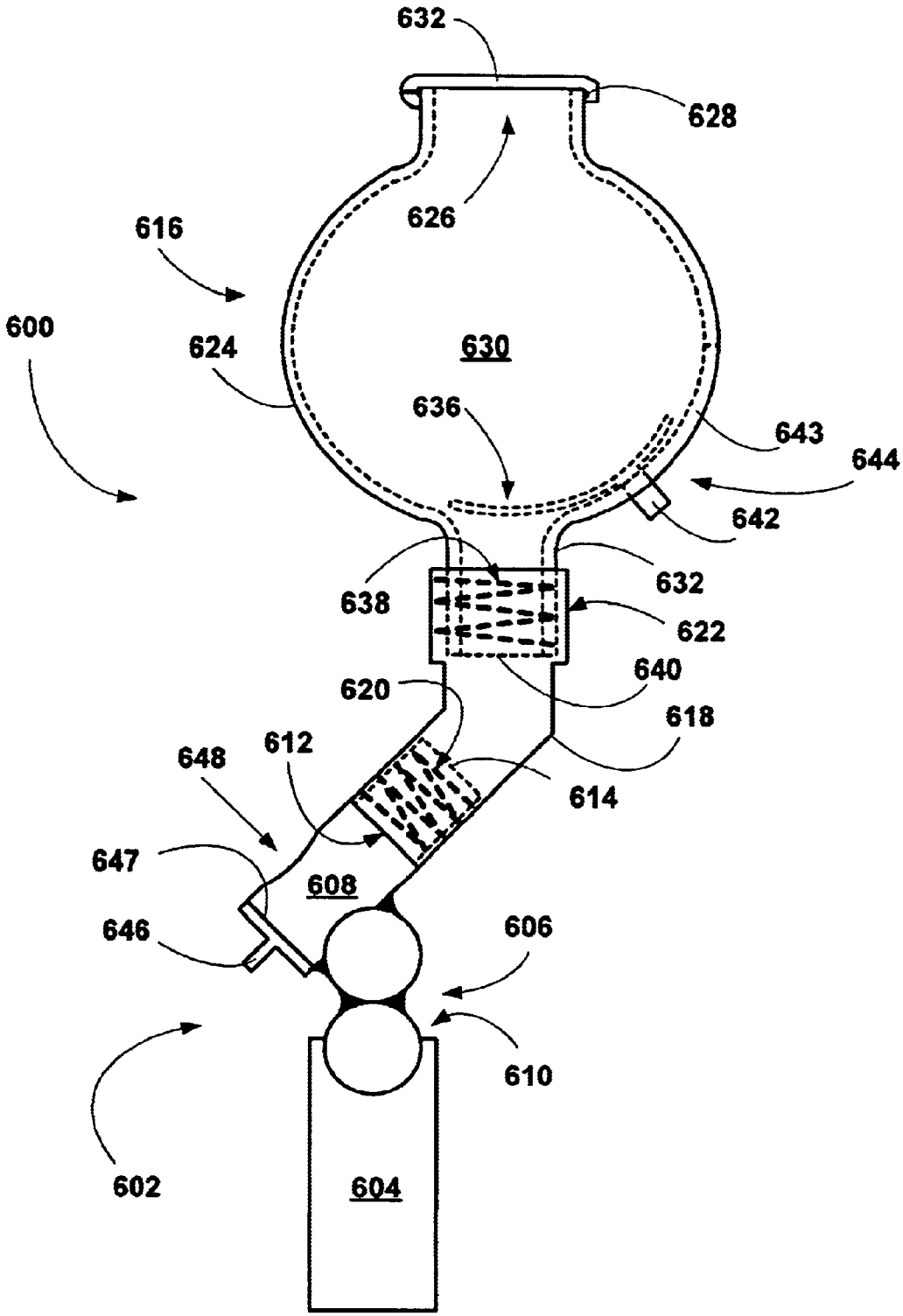
FIG. 6A depicts another preferred embodiment of a paint ball gun having a connecting member and a hopper/feeder apparatus, where the connecting member connects to the feed tube and to the hopper/feeder apparatus and the connection between the connecting member is via a threaded connection.

Referring now to FIG. 6A, another preferred embodiment of a paint ball gun of this invention, generally 600, is shown to include a gun body 602 having a handle 604, a barrel 606 and a hollow, paint ball feed tube 608 extending upward from the barrel 606 near its handle end 610. The feed tube 608 includes a male connector 612 at its distal end 614. The gun 600 also includes a spherically shaped, paint ball hopper/feeder apparatus 616 and a bent connecting member 618. The connecting member 618 includes a gun side, female connector 620 for engaging the feed tube connector 612 and a hopper/feeder side, female connector 622 for engaging the hopper/feeder apparatus 616.

The hopper/feeder apparatus 616 includes a spherically shaped outer shell 624, an open top end 626 having a lip 628, a paint ball reservoir 630, and a hinged cover or lid 632. The lid 630 is designed to detachably engage the lip 626 of the open top end 624 so that the open top end 624 can be closed after the hopper/feeder apparatus 616 is filled with paint balls (not shown). The hopper/feeder apparatus 616 also includes a paint ball dispensing tube or neck 634 depending from a central bottom portion 636 of the magazine 616, where the neck 634 includes a male, threaded connector 638 at this distal end 640, where the connectors 622 and 638 are designed to lockingly secure the paint hopper/feeder apparatus 616 to the connecting member 618 and the connectors 612 and 620 are designed to secure the connecting member 618 with the magazine 616 secured thereto to the feed tube 608. The magazine 616 also includes a slidable closing member 642. The closing member 642 slides in a slot 643 in a bottom portion 644 of the outer shell 624. The feed tube 608 also includes a safety 646 at its proximal end 647 and a view slot 648.

Figure 6B:
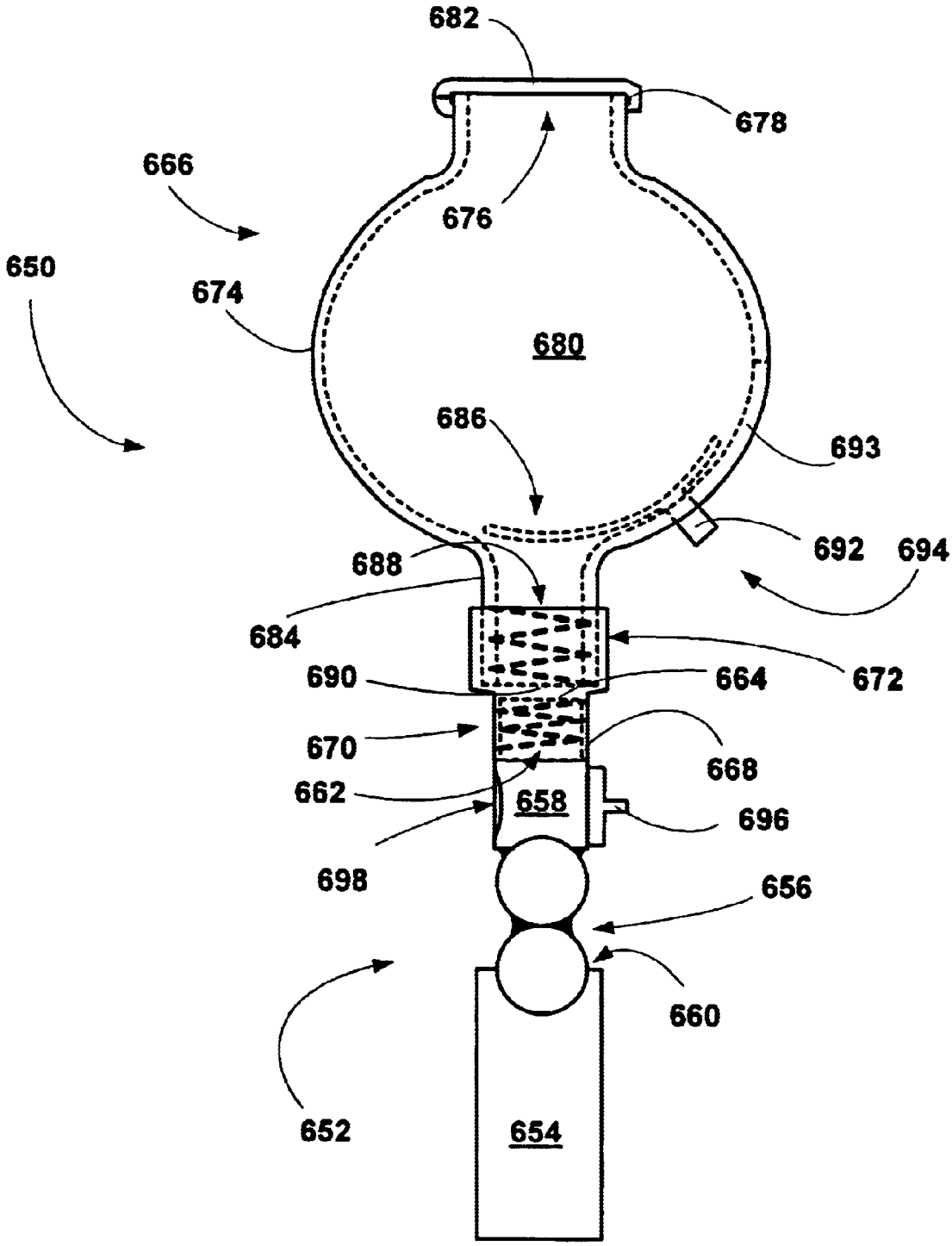
FIG. 6B depicts another preferred embodiment of a paint ball gun having a connecting member and a hopper/feeder apparatus, where the connecting member connects to the feed tube and to the hopper/feeder apparatus and the connection between the connecting member is via a threaded connection and a tightening member.

Referring now to FIG. 6B, another preferred embodiment of a paint ball gun of this invention, generally 650, is shown to include a gun body 652 having a handle 654, a barrel 656 and a hollow, paint ball feed tube 658 extending upward from the barrel 656 near its handle end 660. The feed tube 658 includes a male connector 662 at its distal end 664. The gun 650 also includes a paint ball hopper/feeder apparatus or magazine 666 and a straight connecting member 668. The connecting member 668 includes a female connector 670 for engaging the feed tube connector 662 and a female, threaded hopper/feeder apparatus connector 672.

The magazine 666 includes a spherically shaped outer shell 674, an open top end 676 having a lip 678, a paint ball reservoir 680, and a hinged cover or lid 682. The lid 682 is designed to detachably engage the lip 678 of the open top end 676 so that the open top end 676 can be closed after the hopper/feeder apparatus 666 is filled with paint balls (not shown). The magazine 666 also includes a paint ball dispensing neck 684 depending from a lower central region 686 of the magazine 666, where the neck 684 includes a male, threaded connector 688 at its distal end 690. The connectors 672 and 688 are designed to lockingly secure the magazine 666 to the connecting member 668, while the connectors 662 and 670 are designed to secure the connecting member 668 with the magazine 666 secured thereto to the feed tube 658. The magazine 666 also includes a slidable closing member 692. The closing member 692 slides in a slot 693 in a bottom portion 694 of the outer shell 674. The feed tube 658 also includes a safety 696 and a view slot 698.

It should be recognized that the embodiments depicted in FIGS. 6A and 6B can also include tighteners associated with the connectors 670 and 672 or if the gender of the connectors are reversed, then the connectors 662 and 688 as described in FIGS. 1B–E. Of course, the connectors can be of any gender provided that its mate is the opposite gender.

Figure 7:
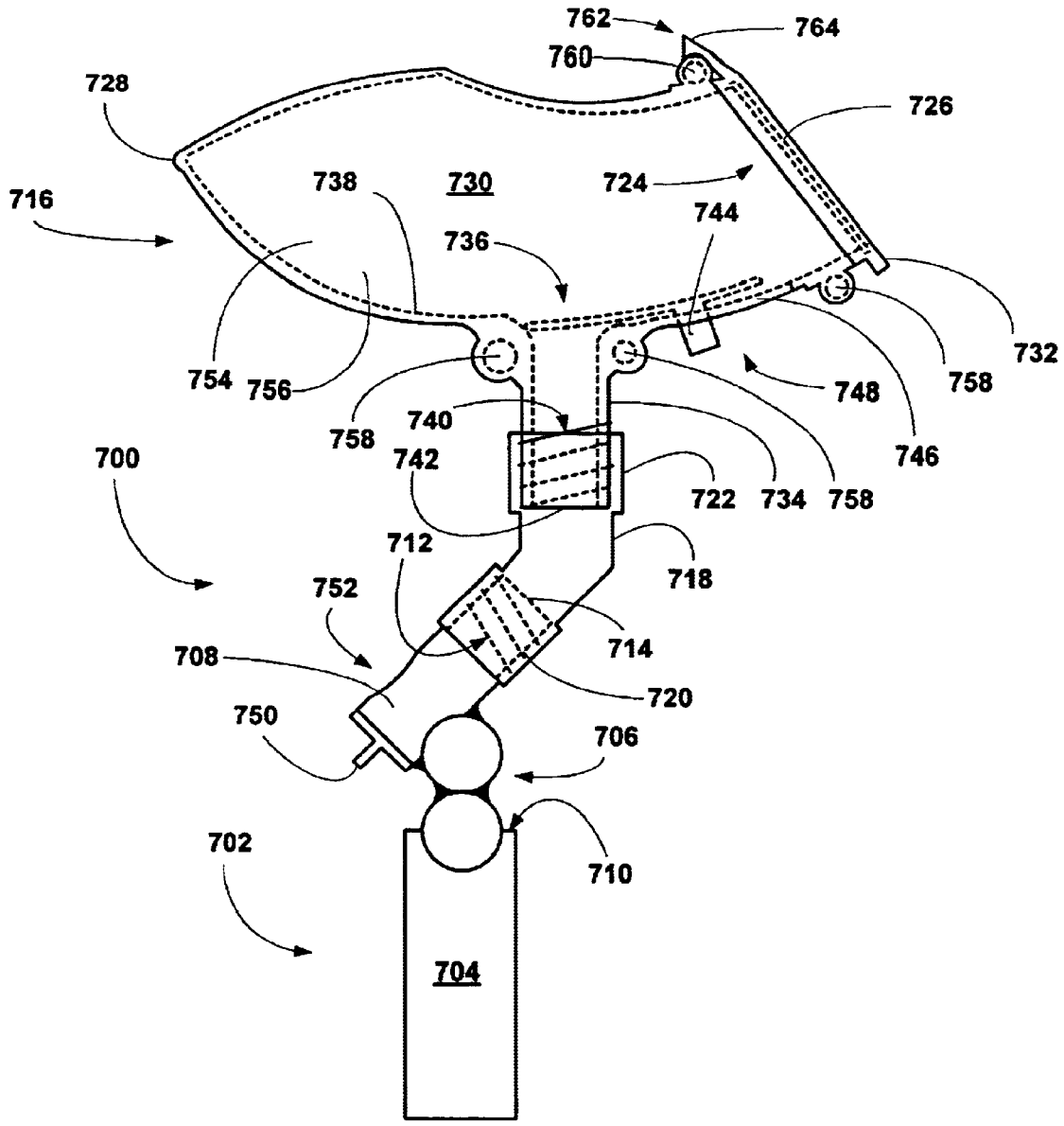
FIG. 7 depicts another preferred embodiment of a paint ball gun having a bent connecting member and a hopper/feeder apparatus, where the connecting member connects to the feed tube and to the hopper/feeder apparatus and the connection between the connecting member is via a threaded connection.

Referring now to FIG. 7, another preferred embodiment of a paint ball gun of this invention, generally 700, is shown to include a gun body 702 having a handle 704, a barrel 706 and a hollow, paint ball feed tube 708 extending upward from the barrel 706 near its handle end 710. The feed tube 708 includes a male connector 712 at its distal end 714. The gun 700 also includes a banana-shaped, paint ball hopper/feeder apparatus 716 and a bent connecting member 718. The connecting member 718 includes a female connector 720 for engaging the feed tube connector 712 and a female, threaded hopper/feeder apparatus connector 722.

The hopper/feeder apparatus 716 includes an open end 724 having a lip 726, a closed end 728, a paint ball reservoir 730, and a lid or cover 732. The cover 732 is designed to engage the lip 726 of the opened end 724 so that the opened end 724 can be closed after the hopper/feeder apparatus 716 is filled with paint balls (not shown). The hopper/feeder apparatus or magazine 716 also includes a paint ball dispensing neck 734 depending from a lower central region 736 of an arcuate bottom contour 738 of the hopper/feeder apparatus 716. The neck 734 includes a male, threaded connector 740 at this distal end 742, where the connectors 722 and 740 are designed to lockingly secure the paint hopper/feeder apparatus 716 to the connecting member 718 and the connectors 712 and 720 are designed to secure the connecting member 718, with the magazine 716 secured thereof, to the feed tube 708. The magazine 716 also includes a slidable closing member 744. The closing member 744 slides in a slot 746 in a bottom portion 748 of the magazine 716. The feed tube 708 also includes a safety 750 and a view slot 752. The magazine 716 is constructed of two halves 754 and 756 held together by fasteners 758 and 760. The faster 760 also serves to pivotally mount the lid 732 at its proximal end 762 via arm 764.

It should be recognized that the embodiments depicted in FIG. 7 can also include tighteners associated with the connectors 720 and 722 or if the gender of the connectors are reversed, then the connectors 712 and 740 as described in FIGS. 1B–E. Of course, the connectors can be of any gender provided that its mate is the opposite gender. It should also be recognized that the connecting member, the gun body and the magazine do not require locking interconnections—the threaded connections are not necessary provided that the closing member is present. Moreover, the assembly does not even require the connecting member.

Closing Assemblies

Figures 8A, 8B, 8C:
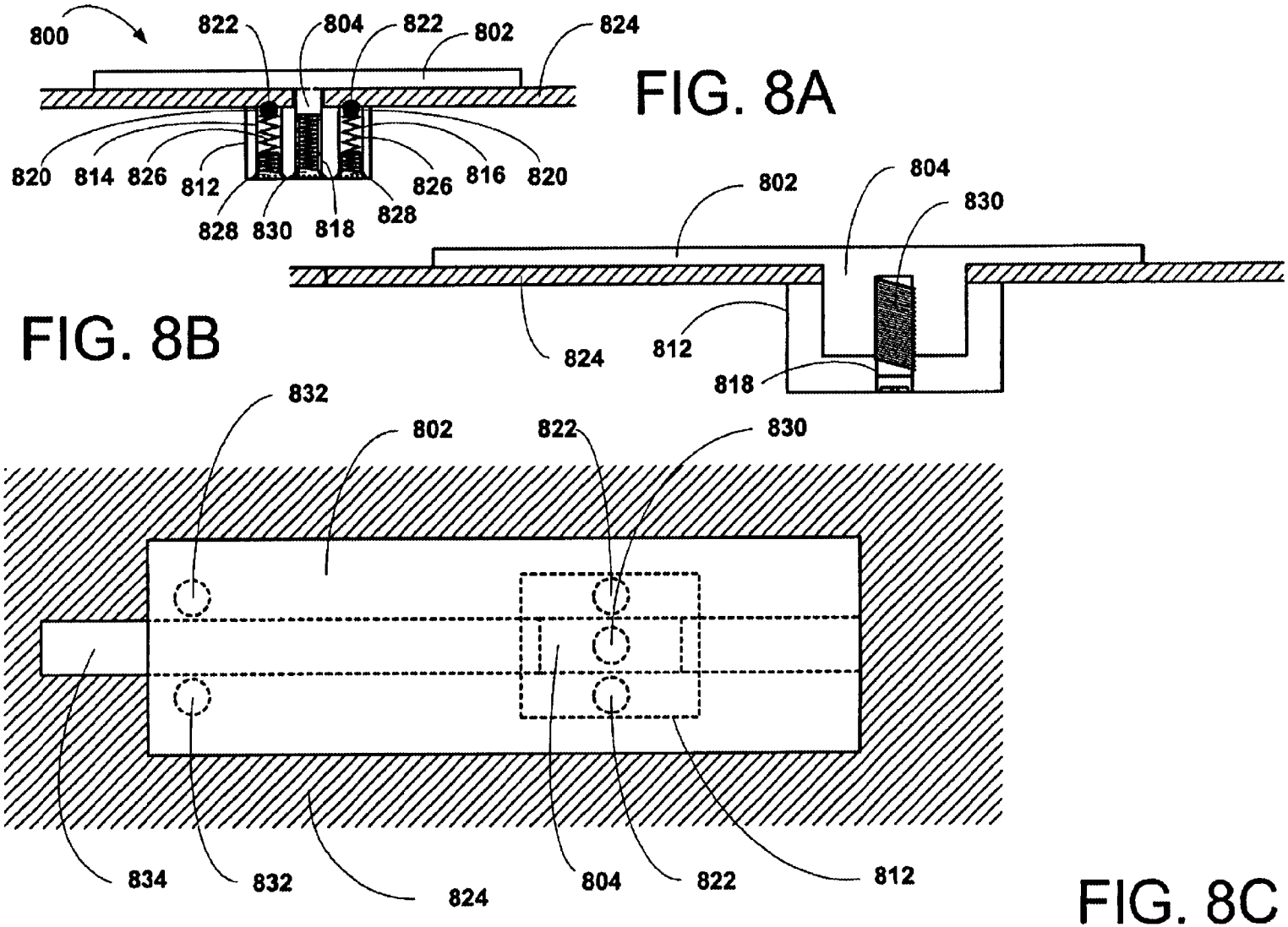
FIGS. 8A–C depict a cross-sectional view, a side view and a top interior plan view of a preferred embodiment of a closing system for the hopper/feeder apparatus of this invention, respectively.
Figures 9A, 9B, 9C, 9D:
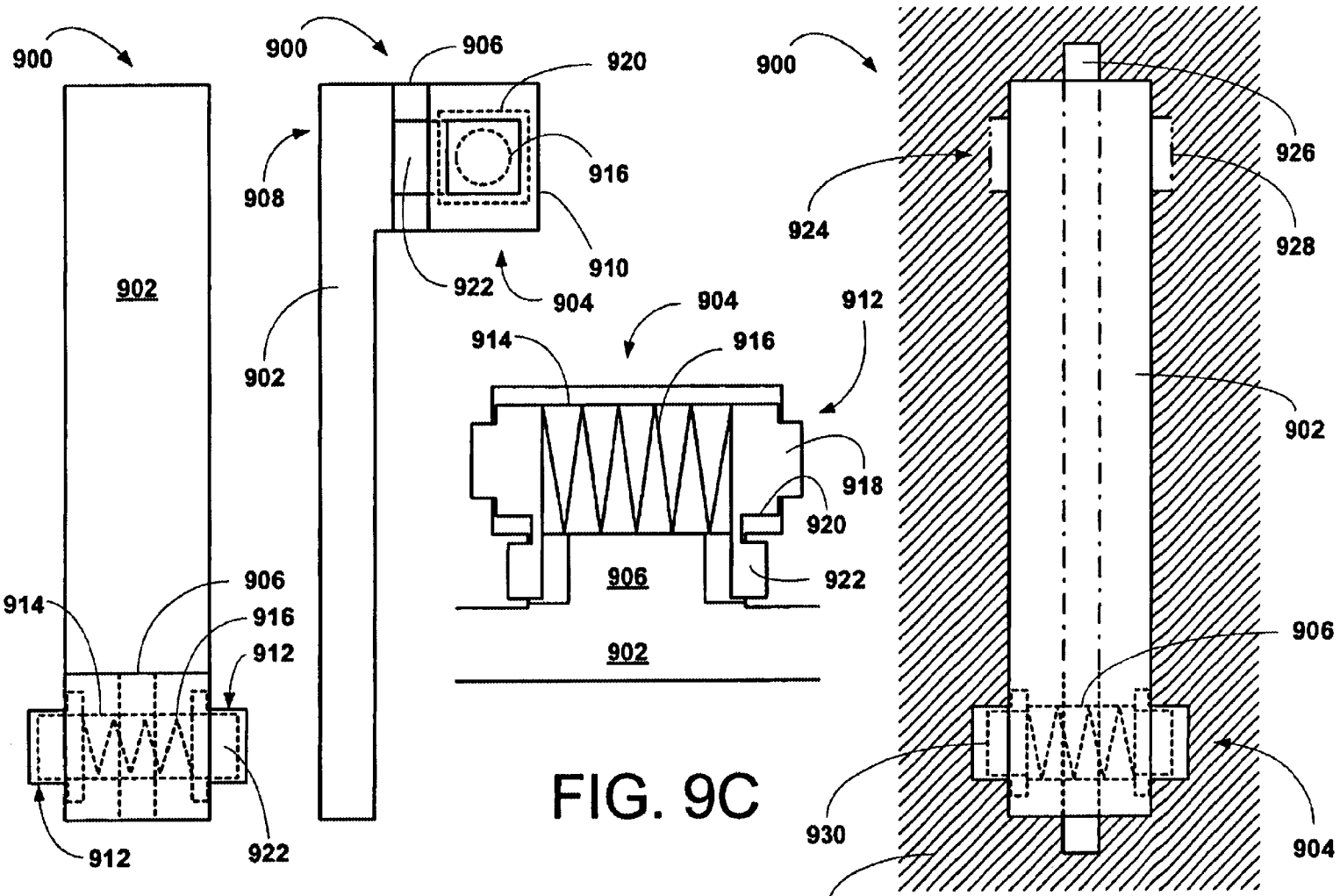
FIGS. 9A–D depict two top plan views, a front view, and side plan view of another preferred embodiment of a closing system for the hopper/feeder apparatus of this invention and an exterior plan view of the closing system integrated into hopper/feeder apparatus, respectively.

Referring now to FIGS. 8A–C, a preferred slidable closing assembly of this invention, generally 800, is shown to include a tongue 802 having a tab 804 depending from a portion 806 having an aperture 808. The tab 804 shown here is located off center, but the tab 804 can be at any location on the tongue 802 provided that the tongue 802 is still able to prevent paint balls from entering the neck from the interior of the magazine when the closing assembly 800 is in its closed state. The closing assembly 800 also includes a spring loaded slide bar 810. The slide bar 810 includes a substantially rectangular body 812, two side apertures 814 and 816 and one center aperture 818. The two side apertures 814 and 816 include a ball 820 held into an indentation 822 in an outer shell 824 of a magazine (not shown) by a spring 826 held in place by a screw 828. The center aperture 818 includes a tongue screw 830 designed to secure the bar 810 to the tab 804 of the tongue 802. Once the tongue screw 830 is in place, then a user can move the bar 810 from an open position as shown in FIG. 8C, where the balls 820 are in the indentations 822 to a closed position indicated by closed indentation 832 designed to receive the spring loaded balls 820 along the slot 834.

Referring now to FIGS. 9A–D, another a preferred slidable closing assembly of this invention, generally 900, is shown to include a tongue 902 and a slide bar 904 with a neck 906 interposed therebetween located at an end portion 908 thereof. The slide bar 904 includes a substantially rectangular body 910, two button assemblies 912, an aperture 914 retaining a spring 916. The button assemblies 912 include first protrusion 918 having a retainer 920, where the protrusions 918 are designed to be engaged by a user's finger and thumb so that the button assemblies 912 can be pushed in. The button assemblies 912 also includes a second protrusion 922, where the second protrusions 922 are designed to engage indentations 924 in a slot 926 of an outer shell 927 of a magazine. The closing assembly 900 is designed to be moved from an open position as shown in FIG. 8D, where the second protrusions 922 engage an open position indentations 928 associated with the slot 926, to a closed position where the second protrusions 922 engage a closed position indentations 930 associated with the slot 926.

Figure 10B:
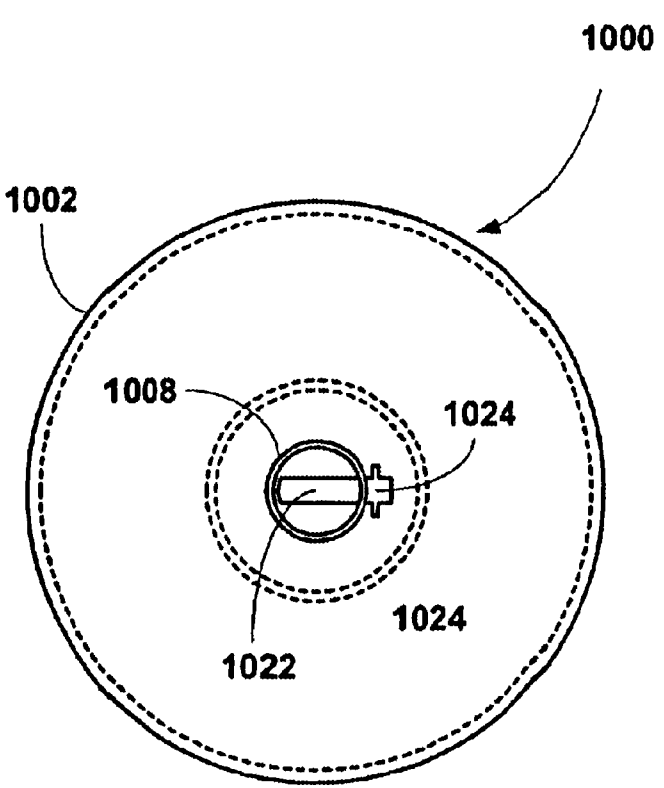
FIGS. 10A–B depict a side view and a bottom view of another preferred embodiment of a closing system for the hopper/feeder apparatus of this invention.
Figure 10A:
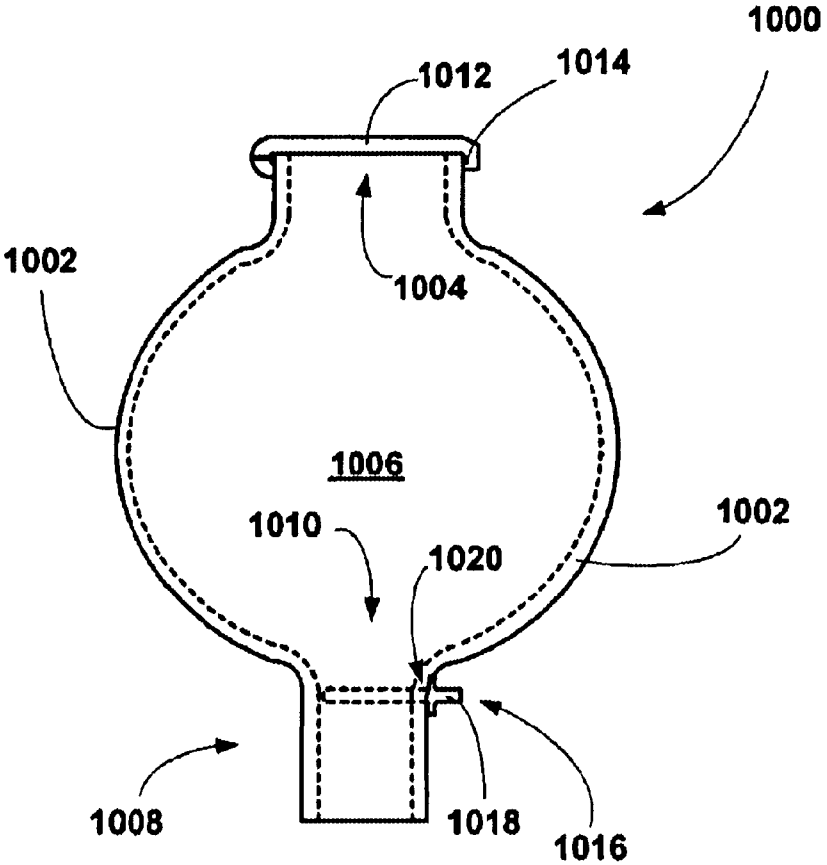

Referring now to FIGS. 10A–B, a spherical magazine, generally 1000, having another preferred closing assembly of this invention, where the magazine 1000 is shown to include an outer shell 1002, an open top 1004, an interior 1006 adapted to hold a plurality of paint balls (not shown), a dispensing tube or neck 1008 depending from a center, bottom region 1010 of the magazine 1000, a lid 1012 designed to detachable engage a lip 1014 associated with the open end 1004 of the magazine 1000 and a closing member 1016. The closing member 1016 comprises a simple blade 1018, which is inserted into a slot 1020 in the neck 1008 prior to filling the magazine 1000 with paint balls. The blade 1018 includes a tongue 1022 and a head 1024, where the tongue 1022 is designed to prevent paint balls exiting the neck 1008 of the magazine 1000 until the blade 1018 is removed by a user grabbing the head 1024 to remove the blade 1018. Looking at FIG. 10B, the magazine 1000 with the blade 1018 inserted therein is shown in a bottom view.

Figures 11A, 11B:
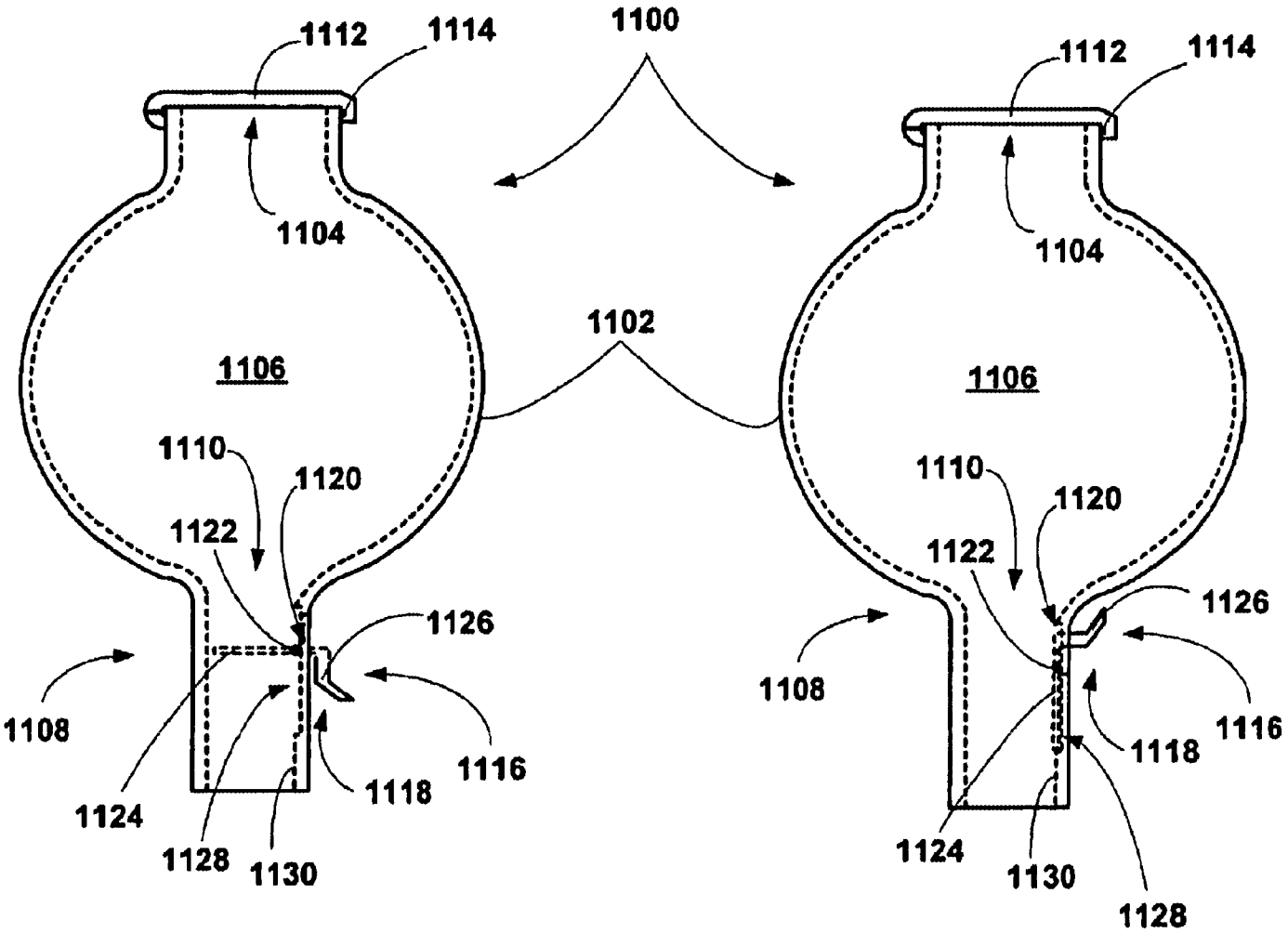
FIGS. 11A–B depict two side views of another preferred embodiment of a closing system for the hopper/feeder apparatus of this invention, one view shows the closed state and one view shows the open state, respectively.

Referring now to FIGS. 11A–B, a spherical magazine, generally 1100, having another preferred closing assembly of this invention, where the magazine 1100 is shown to include an outer shell 1102, an open top 1104, an interior 1106 adapted to hold a plurality of paint balls (not shown), a dispensing tube or neck 1108 depending from a center, bottom region 1110 of the magazine 1100, a lid 1112 designed to detachable engage a lip 1114 associated with the open end 1104 of the magazine 1100 and a closing member 1116. FIG. 11A shows the closing member 1116 in a closed state, while FIG. 11B shows the closing member 1116 in an open state. The closing member 1116 comprises a exterior flip tab 1118 pivotally mounted in a slot 1120 in the neck 1108 by a pin 1122. The tab 1118 includes a tongue 1124 and a flip head 1126, where the tongue 1124 prevent paint balls exiting the neck 1108 of the magazine 1100 until a user flips the tab 1118 up using the flip head 1126, which cause the tongue 1124 to recess into a groove 1128 in an inner surface 1130 of the neck 1108.

Figures 12A, 12B:
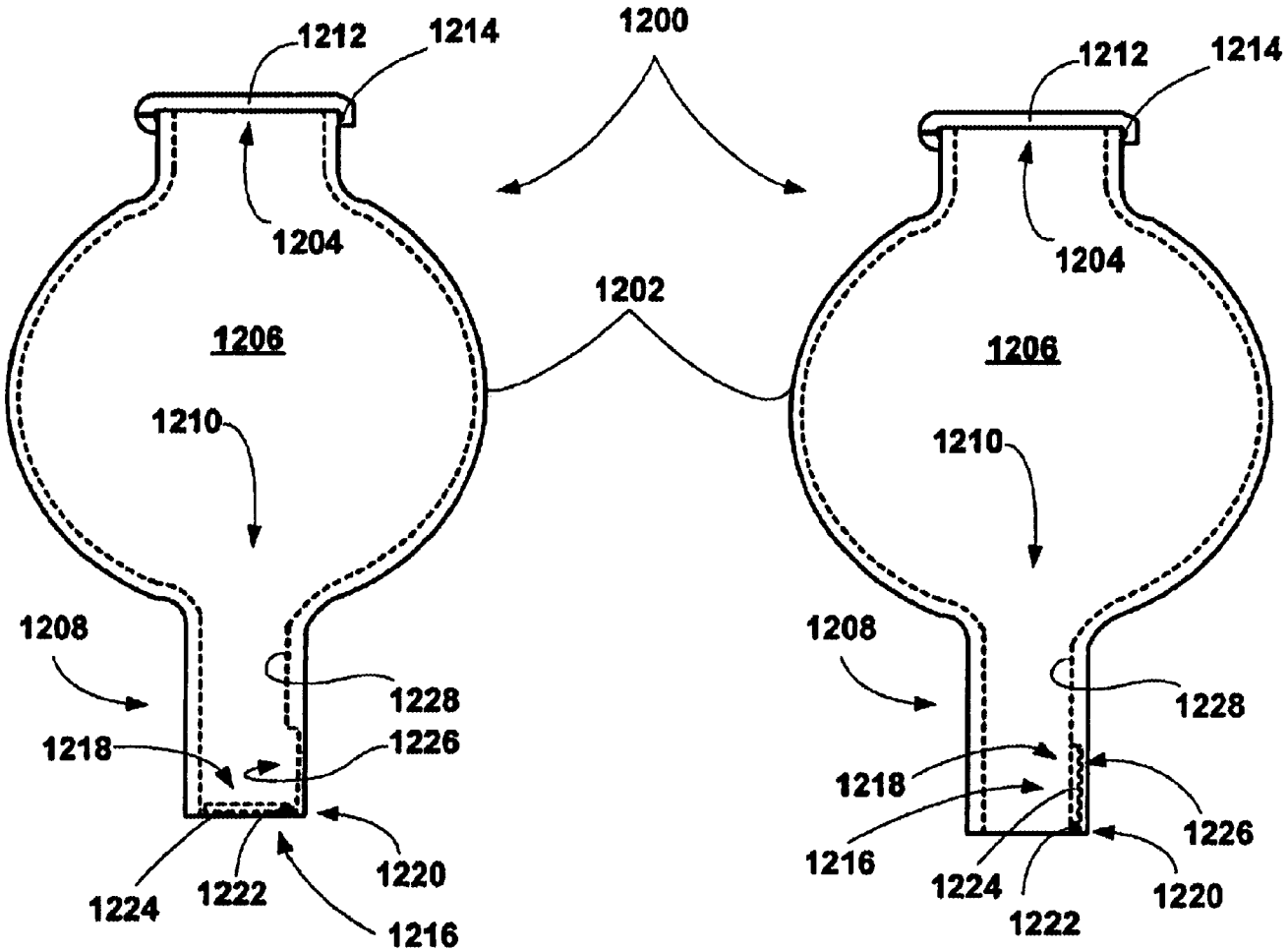
FIGS. 12A–B depict two side views of another preferred embodiment of a closing system for the hopper/feeder apparatus of this invention, one view shows the closed state and one view shows the open state, respectively.

Referring now to FIGS. 12A–D, a spherical magazine, generally 1200, having another preferred closing assembly of this invention, where the magazine 1200 is shown to include an outer shell 1202, an open top 1204, an interior 1206 adapted to hold a plurality of paint balls (not shown), a dispensing tube or neck 1208 depending from a center, bottom region 1210 of the magazine 1000, a lid 1212 designed to detachable engage a lip 1214 associated with the open end 1204 of the magazine 1200 and a closing member 1216. FIG. 12A shows the closing member 1216 in a closed state, while FIG. 21B shows the closing member 1216 in an open state. The closing member 1216 comprises an interior flip tab 1218 pivotally mounted at a bottom 1220 of the neck 1208 by a pin 1222. The tab 1218 includes a tongue 1224, where the tongue 1224 is designed to prevent paint balls exiting the neck 1208 of the magazine 1200 until the magazine 1200 is attached to either a feed tube of a paint ball gun (not shown) or a connecting member (not shown) that includes a finger that forces the tab 1218 up causing the tongue 1224 to recess into a groove 1226 in an inner surface 1228 of the neck 1208.

Although several preferred embodiments of closing assemblies of this invention are shown, it should be clear to an ordinary artisan that any closing assembly can be used as well all of which are intended to be covered in the appended claims.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A paint ball gun comprising a handle, a barrel, a feed tube and a paint ball hopper/feeder apparatus or magazine, where the magazine includes an outer shell, a paint ball reservoir, an open end having a lid, a hollow neck and a closing assembly, where the closing assembly has a closed state and an open state and where paint balls can exit the magazine into the barrel through the neck and feed tube when the closing assembly is in the open state and paint balls cannot exit the magazine into the barrel through the neck and feed tube when the closing assembly is in the closed state.

2. The gun of claim 1, wherein the closing assembly comprises a slot in a bottom portion of the outer shell of the magazine and a closing member adapted to slide in the slot between the open state and closed state.

3. The gun of claim 1, wherein the closing assembly comprises a slot in neck and a closing member adapted to be removed from the slot to transition the assembly from its closed state and its open state.

4. The gun of claim 1, wherein the closing assembly comprises a groove in an inner surface of the neck and a closing member adapted to fit in the groove when the assembly is in its open state and extend across the neck when the assembly is in its closed state.

5. The gun of claim 1, wherein the neck includes a first connector as its distal end, where the connector is designed to lockingly engage a second connector on paint ball gun feed tube, where the connectors are threaded connectors or snap connectors.

6. The gun of claim 5, wherein the neck further includes a tightener adapted to increase a locking force of the threaded connectors.

7. The gun of claim 1, wherein the neck further includes a tightener adapted to secure the magazine to the feed tube.

8. The gun of claim 1, wherein the hopper/feeder apparatus comprises a unitary structure and the lid is pivotally mounted on the open end of the hopper/feeder apparatus or the hopper/feeder apparatus comprises a first half and a second half held together by a plurality of fasteners and wherein the lid is pivotally mounted on the open end of the hopper/feeder apparatus.

9. A paint ball gun comprising a handle, a barrel, a feed tube, a paint ball magazine, and a hollow connecting member interposed between the magazine and the feed tube, where the magazine includes an outer shell, a paint ball reservoir, an open end having a lid, a hollow neck and a closing assembly, where the closing assembly has a closed state and an open state and where paint balls can exit the magazine into the barrel through the neck and feed tube when the closing assembly is in the open state and paint balls cannot exit the magazine into the barrel through the neck and feed tube when the closing assembly is in the closed state.

10. The gun of claim 9, wherein the closing assembly comprises a slot in a bottom portion of the outer shell of the magazine and a closing member adapted to slide in the slot between the open state and closed state.

11. The gun of claim 9, wherein the closing assembly comprises a slot in neck and a closing member adapted to be removed from the slot to transition the assembly from its closed state and its open state.

12. The gun of claim 9, wherein the closing assembly comprises a groove in an inner surface of the neck and a closing member adapted to fit in the groove when the assembly is in its open state and extend across the neck when the assembly is in its closed state.

13. The gun of claim 9, wherein the neck includes a first detachable connector as its distal end, where the first connector is designed to lockingly engage a second detachable connector associated with a first end of the connecting member and the feed tube includes a third detachable connector, where the third connector is designed to lockingly engage a forth detachable connector associated with a second end of the connecting member and where the connectors s are threaded connectors or snap connectors.

14. The gun of claim 13, wherein the connecting member further includes tighteners associated with the second and third connectors adapted to increase a locking force of the threaded connectors.

15. The gun of claim 9, wherein the neck further includes a tightener adapted to secure the magazine to the feed tube.

16. The gun of claim 9, wherein the hopper/feeder apparatus comprises a unitary structure and the lid is pivotally mounted on the opened end of the hopper/feeder apparatus or the hopper/feeder apparatus comprises an first half and a second half held together by a plurality of fasteners and wherein the lid is pivotally mounted on the opened end of the hopper/feeder apparatus.

17. A paint ball hopper comprising an outer shell, a paint ball reservoir, an open end having a lid, a hollow neck and a closing assembly, where the closing assembly has a closed state and an open state and where paint balls can exit the hopper into a barrel through the a neck and a feed tube when the closing assembly is in the open state and paint balls cannot exit the hopper into the barrel through the neck and feed tube when the closing assembly is in the closed state.

18. The hopper of claim 17, wherein the closing assembly comprises a slot in a bottom portion of the outer shell of the hopper and a closing member adapted to slide in the slot between the open state and closed state.

19. The hopper of claim 17, wherein the closing assembly comprises a slot in the neck and a closing member adapted to be removed from the slot to transition the assembly from its closed state and its open state.

20. The hopper of claim 17, wherein the closing assembly comprises a groove in an inner surface of the neck and a closing member adapted to fit in the groove when the assembly is in its open state and extend across the neck when the assembly is in its closed state.

21. The hopper of claim 17, wherein the neck includes a detachable connector as its distal end, where the connector is designed to lockingly engage a connector on paint ball gun feed tube or a connecting member.

22. The hopper of claim 17, wherein the hopper comprises a unitary structure and the lid is pivotally mounted on the opened end of the hopper or the hopper comprises an first half and a second half held together by a plurality of fasteners and wherein the lid is pivotally mounted on the opened end of the hopper.

* * * * *